United States Patent [19]

Berger

[11] Patent Number: 4,675,064

[45] Date of Patent: Jun. 23, 1987

[54] SMOKE FILTER HAVING EXTENDED FILM OVERWRAP AND METHOD AND APPARATUS FOR FABRICATING SAME

[75] Inventor: Richard M. Berger, Midlothian, Va.

[73] Assignee: American Filtrona Corporation, Richmond, Va.

[21] Appl. No.: 709,993

[22] Filed: Mar. 11, 1985

Related U.S. Application Data

[60] Division of Ser. No. 444,056, Nov. 23, 1982, Pat. No. 4,614,199, which is a continuation-in-part of Ser. No. 333,815, Dec. 23, 1981, Pat. No. 4,499,912, and a continuation-in-part of Ser. No. 333,802, Dec. 23, 1981, Pat. No. 4,423,744.

[51] Int. Cl.[4] ..... A24D 3/02; A24D 3/06

[52] U.S. Cl. ..... 156/244.12; 131/362; 131/365

[58] Field of Search ..... 131/362, 336, 341, 343, 131/345, 340, 365, 361, 340; 483/43–45, 50; 156/244.12, 180

[56] References Cited

U.S. PATENT DOCUMENTS

| | | | |
|---|---|---|---|
| 2,688,380 | 9/1954 | MacHenry | 183/44 |
| 2,739,538 | 3/1956 | Eirich et al. | 131/10 |
| 3,079,978 | 3/1963 | Cobb, Jr. et al. | 156/441 |
| 3,111,702 | 11/1963 | Berger | 15/563 |
| 3,361,137 | 1/1968 | Watson | 131/341 |
| 3,395,714 | 8/1968 | Kahane | 131/15 |
| 3,470,008 | 9/1969 | Watson | 117/4 |
| 3,547,134 | 12/1970 | Dock | 131/261 |
| 3,856,025 | 12/1974 | Sato et al. | 131/264 |
| 3,910,288 | 10/1975 | Hammersmith et al. | 131/10 |
| 4,366,826 | 1/1983 | Horsewell | 131/336 |
| 4,387,728 | 6/1983 | Reynolds et al. | 131/336 |
| 4,423,744 | 1/1984 | Berger | 131/336 |

FOREIGN PATENT DOCUMENTS

| | | | |
|---|---|---|---|
| 953600 | 8/1974 | Canada | 131/17 |
| 982897 | 3/1976 | Canada | 131/17 |
| 1024031 | 1/1978 | Canada | 131/17 |
| 1074657 | 4/1980 | Canada | 131/17 |
| 1125618 | 6/1982 | Canada | 131/17 |
| 1431500 | 4/1976 | United Kingdom | 131/341 |

*Primary Examiner*—V. Millin
*Assistant Examiner*—H. Macey
*Attorney, Agent, or Firm*—Holman & Stern

[57] ABSTRACT

A tobacco smoke filter includes a smoke pervious rod of plastic material about which a smoke impervious plastic overwrap film is extruded. In the preferred embodiment, the overwrap and the rod are made of the same material, e.g., cellulose acetate. By using the same material, waste from the normal filter-making processes can be formed into granules or pellets and rendered molten for re-cycling as the raw material for the overwrap film. The resulting filter can be used with or without a tipping paper cover and can be perforated or not, as desired, to ventilate the filter rod.

1 Claim, 6 Drawing Figures

SMOKE FILTER HAVING EXTENDED FILM OVERWRAP AND METHOD AND APPARATUS FOR FABRICATING SAME

CROSS-REFERENCE TO RELATED APPLICATIONS

This patent application is a divisional application of my co-pending application Ser. No. 444,056, filed Nov. 23, 1982, now U.S. Pat. No. 4,014,199, and entitled "Smoke Filter Having Extended Film Overwrap And Method And Apparatus For Fabricating Same", which is a continuation-in-part of my copending U.S. patent application Ser. No. 333,815, filed Dec. 23, 1981, now U.S. Pat. No. 4,499,912, and entitled "Free Air Dilution Smoke Filter And Method And Apparatus For Fabricating Same" and my copending U.S. patent application Ser. No. 333,802, filed Dec. 23, 1981, now U.S. Pat. No. 4,423,744, and entitled "Tobacco Smoke Filter Contoured To Provide Undiluted Air Flow And Method And Apparatus For Manufacturing Same". The disclosures in these copending patent applications are expressly incorporated herein by reference.

In addition, the subject matter of the following patents and patent application is expressly incorporated herein by reference with respect to the descriptions of the method and apparatus for fabricating the filter of the present invention: U.S. Pat. Nos. 3,637,447; 4,046,063; and 4,075,936; and my U.S. patent application Ser. No. 261,690, now U.S. Pat. No. 4,637,409.

BACKGROUND OF THE INVENTION

1. Technical Field

The present invention relates to filter elements and the method and apparatus for fabricating such filter elements. More particularly, the present invention relates to an improved overwrap for a tobacco smoke filter which considerably reduces filter fabrication costs without introducing undesirable side effects.

Although the present invention is primarily concerned with producing filter means for cigarettes, it should be noted that the products of the present invention are generally useful as filters for any tobacco smoking means, whether they be cigarettes, cigars, pipes, etc. Since filters for cigarettes have particular commercial importance, the preferred embodiments described herein relate to the production of filtered cigarettes.

2. The Prior Art

In fabricating filters for use in connection with cigarettes and the like, a number of different properties of the resultant filter must be taken into consideration. While filtration efficiency (i.e., the ability of the filter to remove undesirable constituents from the tobacco smoke) is a very important property of cigarette filters, filtration efficiency must frequently be compromised in order for the filter to possess a commercially acceptable combination of other properties, including pressure drop, taste, hardness, appearance and cost. For example, the most commonly utilized cigarette filter material, cellulose acetate, has a relatively low filtration efficiency; however, this material has a commercially acceptable overall combination of properties.

The relatively poor filtration efficiency of cellulose acetate has resulted in a long but unsuccessful search for an acceptable substitute. A wide variety of different materials have been tried, including paper, polypropylene, and others, but all have been rejected primarily because they introduce an unacceptable taste to the smoker. It has been found that the taste of cigarette smoke is extremely sensitive to the filter material and to foreign substances in or in contact with the filter material. Even in cases where filters have been modified with plastic tubes or other ingredients, the resulting taste has proven to be commercially objectionable.

In spite of the objectionable taste introduced into smoke by paper, it is the most economical and commercially viable material for plug wrap or overwrap material used to circumscribe a cellulose acetate filter rod. The use of paper overwrap is clearly a compromise of the filter taste property. In order to avoid this compromise in taste, attempts have been made to change the filter structure, the filter material, and the overwrap material; all have been commercially unacceptable. Attempts have also been made to eliminate the overwrap entirely; however, these have been unsuccessful because, without an overwrap, the fabrication machines cannot be operated at high speeds.

OBJECTS AND SUMMARY OF THE INVENTION

It is therefore a primary object of the present invention to provide a smoke filter with an overwrap which does not introduce unpleasant taste to the filtered smoke.

It is a further object of the present invention to provide a smoke filter with an overwrap which can be applied inexpensively and without introducing undesirable properties for the final filter product.

Another object of the present invention is to provide a smoke filter overwrap material which permits production rates to be increased.

Still another object of the present invention is to provide a method and apparatus for fabricating a smoke filter with an overwrap material which achieves the objects and advantages described above.

In accordance with the present invention, a plug wrap or overwrap for a smoke filter rod takes the form of a smoke-impervious plastic film extruded about the rod. The resulting overwrapped filter can be used with or without tipping paper; if tipping is used, the taste of the smoke is unaffected because the smoke-impervious film eliminates contact between the paper and the smoke. Preferably, the film is made from the same material as the filter such as cellulose acetate, so as to avoid introducing taste variations. Utilizing the same material in the filter rod and overwrap also has the advantage of permitting re-cycling of the waste filter material for use as the overwrap film. Plasticizers of the type which are conventionally used in filter rods to bond fibers to one another serve to completely adhere the bonded fibers to the film, thereby eliminating the need for adhesive to hold the fibers to the overwrap. Elimination of this adhesive material reduces the cost and removes another foreign material that can adversely affect taste.

The resulting filter has the advantages of: isolating the filter material from taste-contaminating foreign matter; cost saving of material as compared to paper overwrap; and a higher production rate.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF THE PREFERRED EMBODIMENTS

Figure 1:
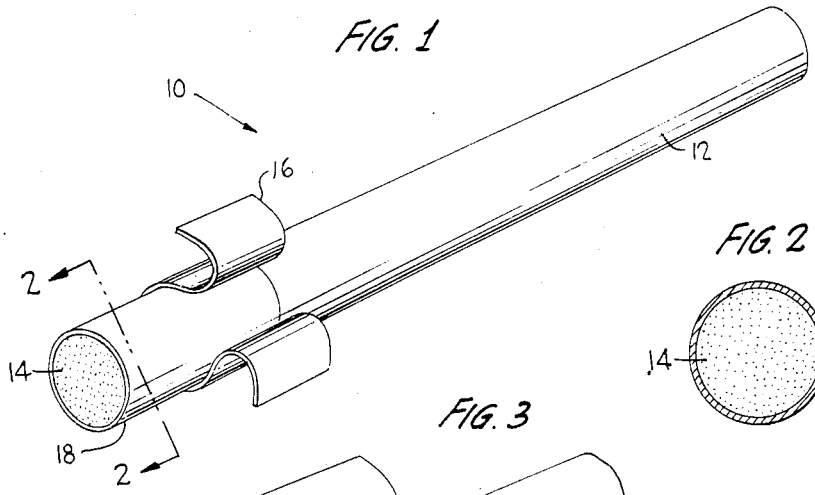
FIG. 1 is a view in perspective of one form of cigarette produced in accordance with the present invention, the tipping paper being partially torn away for illustrative clarity.
Figure 2:
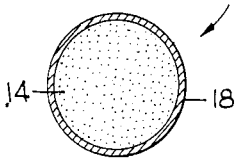
FIG. 2 is a view in section through the filter rod of FIG. 1 taken along lines 2—2 of FIG. 1.

Referring to the drawings with greater specificity and, particularly to FIGS. 1 and 2, a filtered cigarette according to the present invention is generally designated by the reference numberal 10. Cigarette 10 includes a tobacco rod 12 and a filter element 14 constructed in accordance with one embodiment of the present invention. A ring of tipping paper 16 joins the tobacco rod 12 and filter element 14 in axially aligned end-to-end abutment. The tipping paper 16 has a relatively short axial length and extends only a short axial distance along the tobacco rod 12 and the filter element 14. The whole purpose for the tipping paper 16 is to join the tobacco rod 12 and filter element 14; other means of joining these two members may be employed.

The filter element 14 is a generally cylindrical plug of conventional tobacco smoke filter material and is typically made from continuous tow of cellulose acetate filamentary material. It should be noted, however, that other filter material may be employed with slight modifications. For example, filamentary tow formed of other materials such as polyethylene, polypropylene, and the like, or even non-woven staple fibers may be used. It should be understood, however, that cellulose acetate filamentary tow is the preferred material from a commercial standpoint. In this sense, filter plug 14 is fabricated from conventional material to function as a smoke-pervious filter plug for trapping solid particulates in the smoke passing therethrough. Filter plug or rod 14 is circumscribed along its entire length by a smoke-impervious or non-porous plug wrap or overwrap 18. The unique aspect of the filter of the present invention resides in the fact that the overwrap 18 is extruded about the filter plug 14 in the form of a film. In the preferred embodiment, if the filter material is cellulose acetate filamentary tow, then the extruded film is made of cellulose acetate also. In general, the preferred embodiment of the present invention employs the same material for the filter rod and the filter overwrap.

It is important to note that the overwrap film 18 is strictly that, namely, an overwrap. It should not be confused with prior art attempts to extrude entire filter structures, which attempts have proven largely unacceptable from a commercial point of view. Thus, whereas the filter rod 14 has a diameter on the order of 0.25 inches, the thickness of the overwrap film 18 is on the order of 0.25 mils to 2.5 mils and is therefore between 100 and 1,000 times less than the filter rod diameter.

By using an extruded film overwrap having the same material as the filter rod itself, the chance of any foreign ingredients coming into contact with the smoke is virtually nil. Moreover, by introducing conventional plasticizers such as triacetin or any other conventional plasticizer used in cigarette filters, complete adherence of the bonded fibers to the film is assured. This eliminates the need for a separate adhesive material which is required to hold paper overwrap to a filter rod. This not only reduces the cost of the adhesive material but also eliminates another bond of material which could contact and contaminate the taste of the smoke.

A considerable material cost saving is provided when the film overwrap is made from the same material as is employed for making the filter rod. Specifically, using the same material permits re-cycling of the waste from the normal filter-making process. If the filter material is cellulose acetate, for example, all of the waste in making the filter rod is conventional acetate without paper overwrap. This cellulose acetate waste can be formed into granules or pellets and extruded as the overwrap film. This re-cycling is not possible if there is paper contamination in the cellulose acetate waste because molding-grade resin can not be achieved with paper contamination present.

The use of tipping paper 16, as illustrated in FIG. 1, may be dispen. ed with if another technique for bonding the filter rod 14 to the tobacco rod 12 is employed. In either case, the portion of the cigarette which contacts the lips of the smoker is the overwrap material 18 which is smooth and does not stick to the smoker's lips as does paper coating. In addition, the overall surface character of the filter is commercially advantageous with respect to paper overwrap. It should also be noted that the thin film provides structural strength so as to permit high speed filter fabrication operation. Even a very thin film overwrap is sufficient to compress an oversized rod and provide the structural strength necessary for both high speed production and desirable smoking characteristics.

Although the cigarette illustrated in FIGS. 1 and 2 has no provision for air ventilation of the filter, it is clear that holes may be provided in the overwrap film 18 in order to provide ventilation communication between the filter rod 14 and ambient air.

Figure 3:
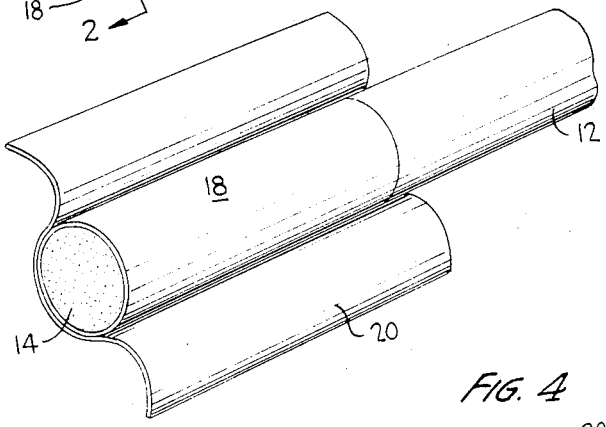
FIG. 3 is a view in perspective of another filter in accordance with the present invention with the tipping paper once again being partially torn away for illustrative clarity.

The cigarette filter embodiment illustrated in FIG. 3 shows a tipping paper overwrap circumscribed about the entire length of the extruded overwrap film 18, as well as a portion of the tobacco rod 12. In all other respects, the filter arrangement of FIG. 3 is identical to that illustrated and described in FIG. 1. It is possible, of course, to deform the filter rod of FIG. 3 in the manner described in my copending U.S. patent application Ser. No. 333,802, in which case the tipping paper 20, suitably provided with ventilation holes, defines a ventilation passage with the deformed portion of the filter rod. The result is air dilution of the smoke, a feature which has gained some popularity in the tobacco industry in recent years.

Figure 4:
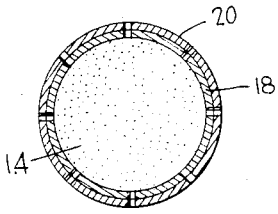
FIG. 4 is a view in section of a filter rod constructed in accordance with the present invention wherein ventilation holes are provided in the tipping paper and filter overwrap.

Referring to FIG. 4 specifically of the accompanying drawings, a filter rod such as that illustrated in FIG. 3, is shown in section and is provided with a plurality of ventilation holes extending through the paper tipping 20 and the film overwrap 18. As noted above, the tipping paper 20 can be eliminated and the holes can extend through the overwrap film 18 alone. The holes serve to admit air into the smoke as the smoker draws on the exposed end of the filter rod, thereby providing a degree of air dilution determined by the number and size of the apertures. The overwrap film can be perforated at the same time that the tipping paper 20 is perforated by any techniques well known in the prior art for this purpose. However, the most uniform perforation method is with lasers.

Figure 5:
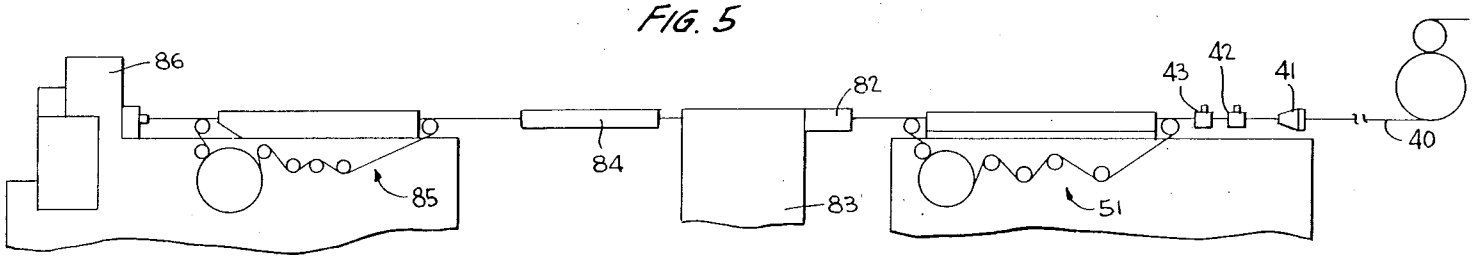
FIG. 5 is a schematic illustration of a method and apparatus for fabricating filter elements in accordance with the present invention.

A method and apparatus for fabricating the filter elements of the present invention is illustrated in FIG. 5, to which specific reference is now made. Basically, the fabrication technique is similar in many respects to the techniques described and illustrated in U.S. Pat. Nos. 3,637,447; 4,046,063; 4,075,936; and U.S. patent application Ser. Nos. 261,690, now U.S. Pat. No. 4,637,409, and 333,802, now U.S. Pat. No. 4,423,744. The filtering material utilized in the production of filter elements is a continuous filamentary tow designated generally by the reference numeral 40. This filamentary tow 40 includes a multiplicity of bondable fibrous members activated by contact with a hot fluid such as steam. Filtering material 40 is continuously passed into and through an elongated bonding zone which includes a conventional stuffer jet 41 and steam head 42, similar in nature to those illustrated and described in the various above-mentioned patents and patent applications. Following the steam treatment, the resulting rod is cooled at cooling head 43 before being passed through a pulling device 51. Upon leaving the pulling device, the unwrapped rod is passed to a vacuum chamber 82 after which the rod is passed to an extruder and tube dye 83, the latter being described in greater detail below with reference to FIG. 6.

In the extruder and tube dye 83, a film of plastic material is extruded over the filter rod so as to conform to the exact shape of the rod. Any suitable smoke-impervious plastic film may be utilized for this purpose and, in the preferred embodiment, is cellulose acetate. The wrapped rod then passes through a water bath 84 to a pulling device 85 before being cut into individual filter plugs at cutter head 86.

Figure 6:
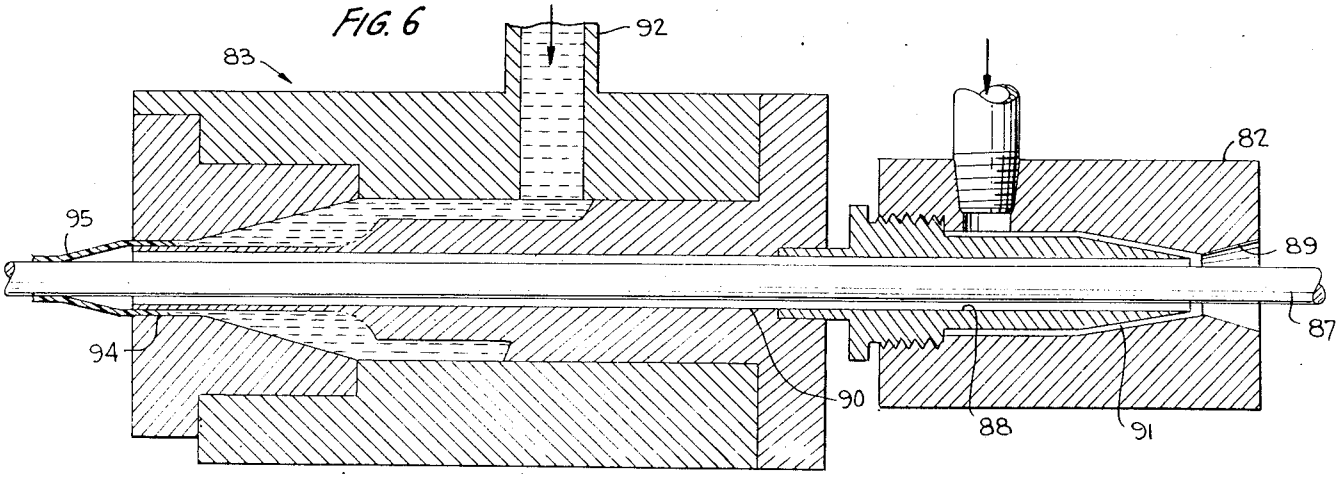
FIG. 6 is a partially schematic view in section of an extrusion apparatus for applying plug wrap to the filter rod in the method and apparatus illustrated in FIG. 5.

Referring specifically to FIG. 6 of the accompanying drawings, the vacuum chamber 82 is illustrated with the unwrapped rod 87 passing through a bore 88 extending longitudinally therethrough. The inlet end 89 of bore 88 is flared to provide a flow outlet which expands in the direction opposite the translation direction of rod 87. Bore 88 is somewhat larger in diameter than the diameter of rod 87 so that air can flow in an annular path through bore 88 in opposition to rod movement. In order to withdraw air from bore 88, an annular nozzle is provided at the point where bore 88 begins to flare in portion 89. The annular nozzle is fed by air under pressure which aspirates air from the bore 88 and out through the flared outlet 89. As a consequence, an extremely low pressure is provided in bore 88. A portion of the vacuum chamber 82 extends into the extruder and tube dye member 83 such that bore 88 communicates coaxially with a similarly provided bore 90 in the tube dye and extruder member 83. Rod 87 passes through bore 90 which is aspirated by the annular nozzle 91 in the same manner as bore 88.

Plastic is fed into the tube dye and extruder member 83 by a nozzle 92 which feeds the plastic in its molten form to an annular nozzle 94 disposed concentrically about the outlet of bore 90. The low pressure region formed around rod 87 in bore 90 causes the annular flow of plastic film from the nozzle 94 to surround and conform to the rod as the rod egresses from the tube dye and extruder member 83. This plastic film 95 constitutes the plug wrap 18 described above in relation to the embodiment illustrated in FIGS. 1–4.

The method described in relation to FIGS. 5 and 6, whereby the vacuum draws the plastic film to the exact shape of the filter rod and permits the smoke-impermeable film to conform to the deformed rod, is considerably cheaper than the conventional plug wrap approach wherein paper is used as the plug wrap. The film 95 is generally extruded to a thickness between 0.25 mils and 2.5 mils, the thickness being controlled by varying the speed ratio between the formed rod and the extruder film.

As noted above, when the filter material 40 and the film 95 are the same, any waste material which is formed during the normal manufacturing process can be re-cycled as the extruded overwrap film 95.

Although the filter rod formed as part of the process illustrated in FIGS. 5 and 6 is cylindrical, the cylindrical periphery can be deformed in the manner described in my aforementioned copending U.S. patent application Ser. No. 333,802, now U.S. Pat. No. 4,423,744, and in my copending U.S. patent application Ser. No. 333,815, now U.S. Pat. No. 4,499,912, in order to achieve air dilution characteristics for the filter.

The apparatus for forming the filter according to the present invention runs more efficiently than do prior art filter fabricating machines because there is no requirement to slow down or stop to change the plug wrap. In fact, with tow splicing equipment incorporated, the machines are capable of running at 100% efficiency around the clock.

Another advantage to using cellulose acetate film as an overwrap for the cellulose acetate tow material is that it may be formulated with a plasticizer to produce a flexible film which prevents formation of air pockets associated with tipping in the paper-wrapped filters. These pockets are caused by the differential in size between the filter and the cigarette. Since paper does not conform, it wrinkles and causes these air pockets to form. The thin film-wrapped filters of the present invention, however, do not require the close circumferential tolerance required by paper-wrapped filters. Using the present invention, I have found that cellulose acetate filter rods of 100 millimeter length can be wrapped at a material cost of 6¢ per thousand rods. The least expensive paper wrap has a material cost of 15¢ per thousand rods and sometimes varies as high as 30¢ per thousand rods, without even considering the cost of glue and other additives employed in conjunction with the paper wrap to produce a satisfactory filter.

In addition to the cellulose acetate, an alternative material which is suitable for use for the plastic film overwrap 18 is Surlyn which is an ionomer sold by DuPont. An ionomer is an ionically crosslinked thermoplastic polymer. The Surlyn ionomer resins are derived from ethylene/methacrylic acid copolymers. This material is a heat seal polymer with high clarity, melt strength and solid state toughness and resistance to oil/fat permeation. Surlyn is available as either a sodium or zinc ionomer, and although all grades generally offer the above properties when compared to other heat-seal polymers, sodium ionomers are known for exceptional toughness and resistance to fats and oils while zinc ionomers exhibit outstanding adhesion to unprimed foil and possess excellent chemical resistance.

Another possible material for the film overwrap is Elvax, an ethylene-vinyl acetate copolymer resin manufactured by DuPont. The vinyl acetate units in the copolymer modify the basic polyethylene structure and properties. By varying the vinyl acetate content and the molecular weight (melt index), properties can be tailored for specific applications.

A variety of different materials can be employed, but it must be stressed that the advantage of using the same material for the overwrap as for the filter rod provides both cost advantages and taste advantages which are not possible in the prior art.

It will be apparent to those familiar with this art that there has been described and illustrated herein a smoke filter and method and means for manufacturing such filter which satisfy various objectives set forth hereinabove and which provide significant commercial advantages.

While I have described and illustrated various embodiments of my invention, it will be clear that variations of the details of construction which are specifically illustrated and described may be resorted to without departing from the true spirit and scope of the invention as defined in the appended claims.

What is claimed is:

1. A method of making smoke filters comprising the steps of:

providing a filtering material including a multiplicity of fibrous cellulose acetate members;

defining an elongated bonding zone;

continuously feeding said filtering material through said bonding zone;

feeding a bond-activating agent into contact with said filtering material in said bonding zone to bond said fibrous members to each other to form an elongated, smoke permeable, generally cylindrical filter rod member having at least one transverse dimension of predetermined length and defining a tortuous path for passage of smoke therethrough; and extruding a thin film of cellulose acetate material about said filter rod member to provide a smoke impervious overwrap having a thickness which is at least 100 times smaller than said predetermined length.

* * * * *